US008449185B1

(12) United States Patent
Koon

(10) Patent No.: US 8,449,185 B1
(45) Date of Patent: May 28, 2013

(54) YARD REFUSE COLLECTION DEVICE

(76) Inventor: Larry D. Koon, Leesville, SC (US)

( * ) Notice: Subject to any disclaimer, the term of this patent is extended or adjusted under 35 U.S.C. 154(b) by 425 days.

(21) Appl. No.: 12/955,740

(22) Filed: Nov. 29, 2010

(51) Int. Cl.
*B65D 33/00* (2006.01)

(52) U.S. Cl.
USPC ..... 383/33; 383/66; 383/67; 220/495.08

(58) Field of Classification Search
USPC 383/33, 66, 67, 34, 34.1, 119, 104; 232/43.1; 248/99, 95, 153, 907; 294/214; 220/9.2, 9.1, 220/495.08–495.11
See application file for complete search history.

(56) References Cited

U.S. PATENT DOCUMENTS

| | | | | | |
|---|---|---|---|---|---|
| 1,588,094 | A | * | 6/1926 | Chambers | 224/608 |
| 1,848,929 | A | * | 3/1932 | Berg | 220/9.2 |
| 3,276,733 | A | * | 10/1966 | Rosser | 248/146 |
| 3,934,803 | A | * | 1/1976 | Paulus, Jr. | 248/101 |
| 4,019,768 | A | * | 4/1977 | Niece | 294/1.3 |
| 4,318,521 | A | | 3/1982 | Martin et al. | |
| 4,470,627 | A | | 9/1984 | Carroll et al. | |
| 4,705,246 | A | * | 11/1987 | Wolf | 248/97 |
| 5,498,046 | A | | 3/1996 | Ridley, Sr. et al. | |
| 5,924,657 | A | * | 7/1999 | Bach | 248/97 |
| 6,053,459 | A | * | 4/2000 | Priefert et al. | 248/97 |
| 6,076,782 | A | * | 6/2000 | Alderman | 248/97 |
| 6,450,461 | B1 | | 9/2002 | Lohmann | |
| 7,785,008 | B2 | * | 8/2010 | Schoenig et al. | 383/4 |
| 2008/0083204 | A1 | * | 4/2008 | Vineis | 56/202 |
| 2009/0289154 | A1 | | 11/2009 | Gabriel | |

* cited by examiner

*Primary Examiner* — Nathan J Newhouse
*Assistant Examiner* — Matthew Theis

(57) ABSTRACT

A free-standing yard refuse collection device including a portable frame body having parallel front and rear frames attached together with braces and a detachable reusable elongated collection bag into which refuse is directly raked or into which a separate leaf collection liner bag is disposed. At least one elongated resealable opening on a top side of the collection bag permits removal of the liner bag filled with yard refuse including leaves.

13 Claims, 5 Drawing Sheets

YARD REFUSE COLLECTION DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of lawn debris collection devices are known in the prior art. However, what is needed is a free-standing yard refuse collection device including a portable support frame body formed of parallel front and rear frames attached together with braces and a detachable reusable elongated collection bag into which refuse is directly raked or into which a separate leaf collection liner bag is disposed. At least one elongated resealable opening on a top side of the collection bag permits removal of the liner bag filled with yard refuse including leaves.

FIELD OF THE INVENTION

The present invention relates to lawn debris collection devices, and more particularly, to a yard refuse collection device which includes a support frame body that has a front frame and a parallel rear frame attached together with braces and which also includes a collection bag which attaches to the front frame and extends over the front and rear frames and a liner bag that fits inside the collection bag as an alternate for collecting yard refuse.

SUMMARY OF THE INVENTION

The general purpose of the present yard refuse collection device, described subsequently in greater detail, is to provide a yard refuse collection device which has many novel features that result in a yard refuse collection device which is not anticipated, rendered obvious, suggested, or even implied by prior art, either alone or in combination thereof.

To accomplish this, the present yard refuse collection device provides includes a rigid support frame body. The rigid support frame body includes a cylindrical front frame and a cylindrical rear frame disposed in a position parallel to the front frame. The rear frame has a shorter perimeter than a perimeter of the front frame. Each of the front frame and the rear frame has a pentagonal shape. Each of the front frame and the rear frame has a front side, an inner side, a top side having an apex centrally disposed therein and opposite outer edges, a bottom side having opposite external edges, a first end, and a second end. An internal cavity is disposed between the front frame and the rear frame.

A cylindrical top brace is centrally attached to the inner side of each of the front and rear frames, between the top side apex of each the front and rear frames. A cylindrical bottom brace is centrally attached to the inner side of each of the front and rear frames, between the bottom side of each of the front and rear frames. A cylindrical third brace is attached to the inner side of each of the front and rear frames, between the first end of each of the front and rear frames. A cylindrical fourth brace is centrally attached to the inner side of each of the front and rear frames, between the second end of each of the front and rear frames. The top brace, the bottom brace, the third brace, and the fourth brace are disposed perpendicular to the top side and the bottom side of the front and rear frames.

A plurality of V-shaped fifth braces is attached to the inner side of each of the front frame and the rear frame. One of the fifth braces is centrally disposed between the top brace and the top side outer edge proximal to the third brace. Another one of the fifth braces is centrally disposed between the top brace and the top side outer edge proximal to the fourth brace. Still another one of the fifth braces is centrally disposed between the bottom brace and the bottom side external edge proximal to the first end. Yet another one of the fifth braces is centrally disposed between the bottom brace and the bottom side external edge proximal to the second end.

The present yard refuse collection device also includes a reusable elongated collection bag. The collection bag includes a rectangular lower side; a rectangular upper side; a front end, a rear end, a first side, and a second side; and an interior cavity disposed between the lower side, the upper side, the front end, the rear end, the first side, and the second side. A elongated first loop and a elongated second loop are disposed within the interior cavity proximal to the front end on the upper side and proximal to the front end on the lower side, respectively. Each of the first loop and the second loop have at least one of a plurality of securement members disposed on an exterior end thereof and at least one of the securement members disposed in a position on an internal wall thereof. The securement member members are removably releasable hook and loop fasteners. The collection bag front end continuously attaches to the front frame. The first and second loop, securement members continuously attach the collection bag front end to the front frame. The collection bag extends rearwardly through internal cavity between the front frame and the rear frame. The collection bag is smooth to permit refuse0 to easily slide into the collection bag, durable to permit re-use, water-resistant to permit use in moist conditions and to pick up moist refuse0 without damaging the collection bag, and lightweight to enhance portability of the present device.

At least one resealable elongated opening is central disposed on the upper side. A resealable elongated top opening is centrally disposed on the upper side along a horizontal axis proximal to the front end of the collection bag. A flap releasably covers the entire top opening. A resealable elongated central opening is centrally disposed on the upper side in a position perpendicular to the top opening. A resealable elongated bottom opening is disposed along the entire rear end. The central opening is continuously disposed between the top opening and the bottom opening. A removably attached pair of strips of hook and loop fastening is disposed along each of the top opening and the respective flap, the central opening, and the bottom opening.

A heavy-duty liner bag having a drawstring continuously disposed along a forward edge thereof is also provided. The liner bag forward edge continuously removably attaches to the collection bag front end and the liner bag is disposed within the collection bag interior cavity. Thus, the liner bag, rather than the collection bag, removably contains refuse picked up from a yard therein. The openings allow the liner bag to be easily removed from the collection bag for disposal of the liner bag, which is sealed by pulling the drawstring together prior to removal from the collection bag.

The front frame has a perimeter having a length in a range of 88 inches to 108 inches. The rear frame has a perimeter having a length in a range of 78 inches to 98 inches. These dimensions are optimal for portability of the device when the collection bag or, alternately, the liner bag is full of refuse. The front frame has a longer perimeter than the rear frame to provide a wide mouth on the device for raking and scooping refuse within the collection bag or liner bag while allowing the collection bag or liner bag to drape rearwardly down over the support frame body to push refuse collected therein toward the back of the collection bag or liner bag when the support frame body is lifted. However, smaller and larger embodiments of the device are provided to accommodate smaller and larger amounts of refuse, respectively. The support frame body is formed of a durable, lightweight material including aluminum or polypropylene.

The present device is free-standing in that a user does not have to hold onto the device while raking leaves into the collection bag. The present device is portable, easy to use, convenient, time saving, and reduces strain typically involved in bending over to pick up yard refuse. A user is able to work alone to rake leaves up without difficulty and frustration. The present device does not require a second person to hold a collection bag open while another person fills the bag with refuse.

Thus has been broadly outlined the more important features of the present yard refuse collection device so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
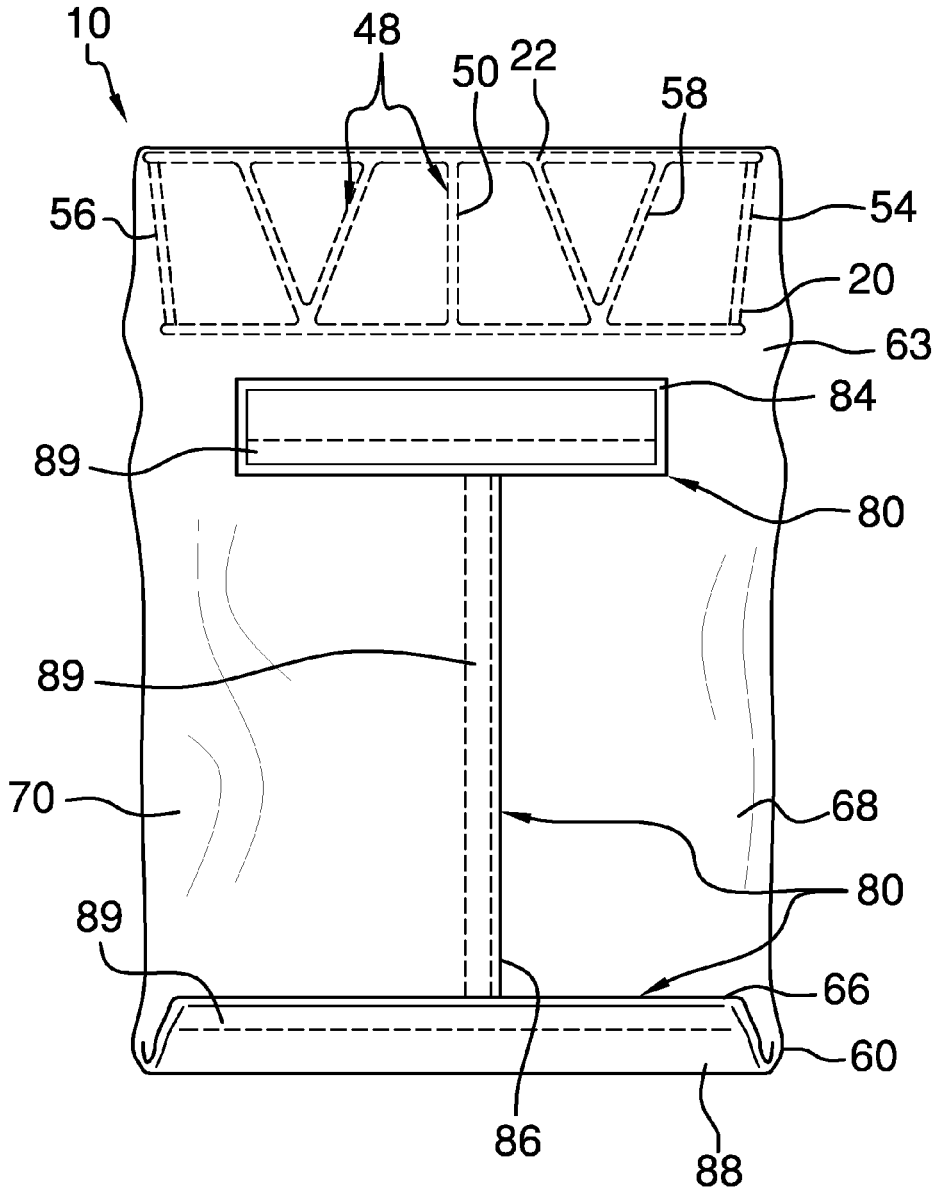
FIG. 1 is a top plan view in a closed position.
Figure 2:
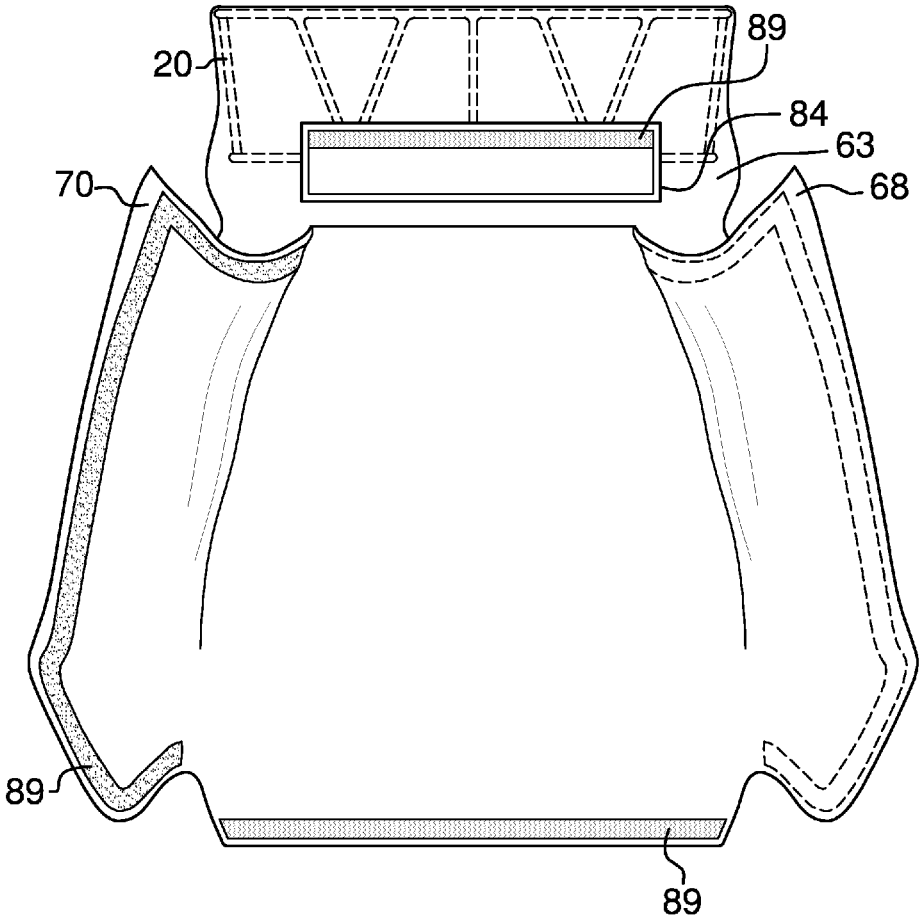
FIG. 2 is a top plan view in an open position.
Figure 3:
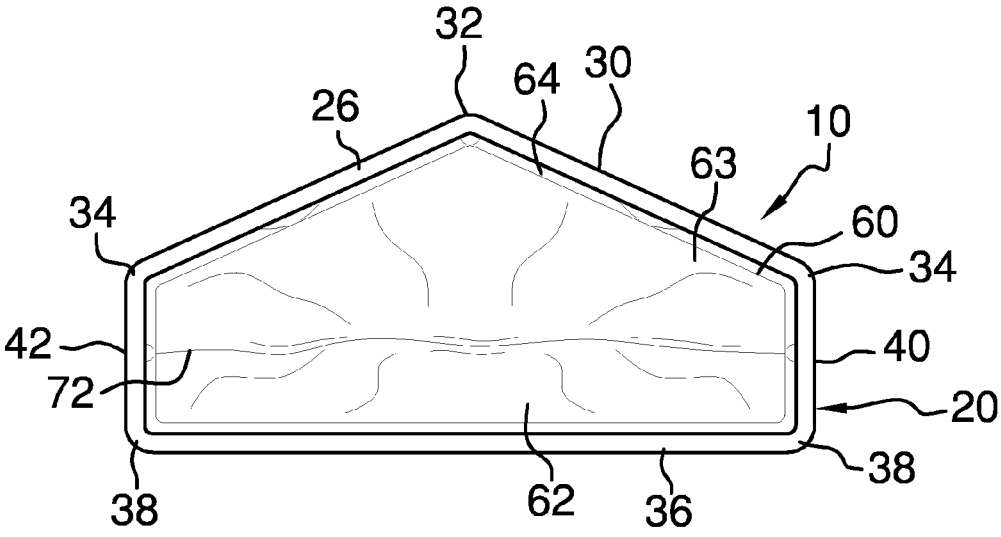
FIG. 3 is a front elevation view.
Figure 4:
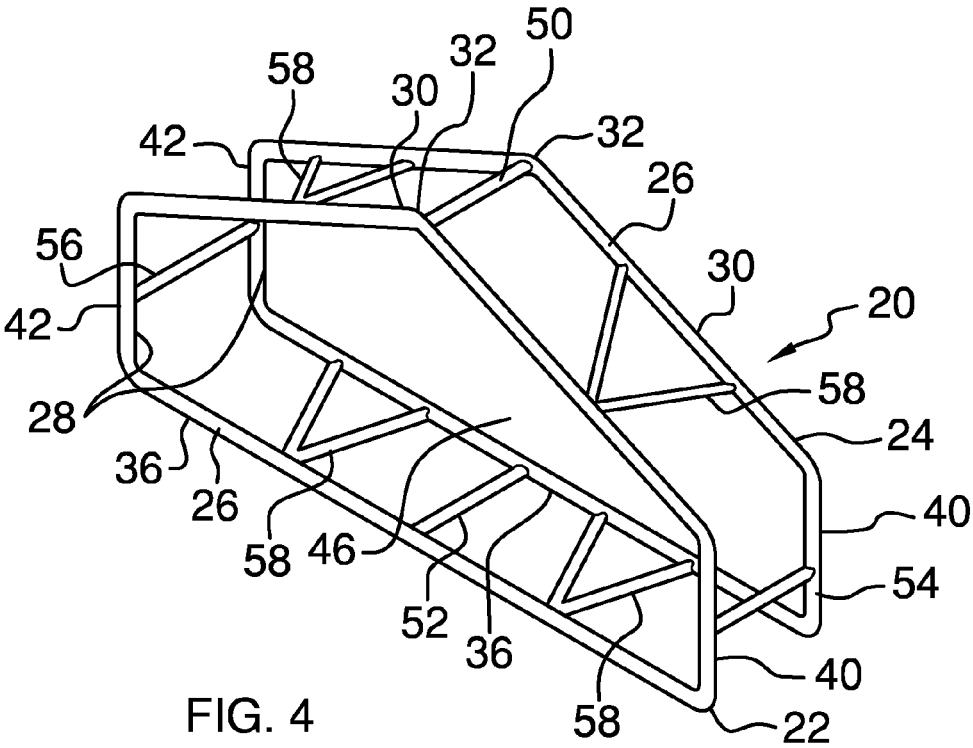
FIG. 4 is an isometric view of a frame.
Figure 5:
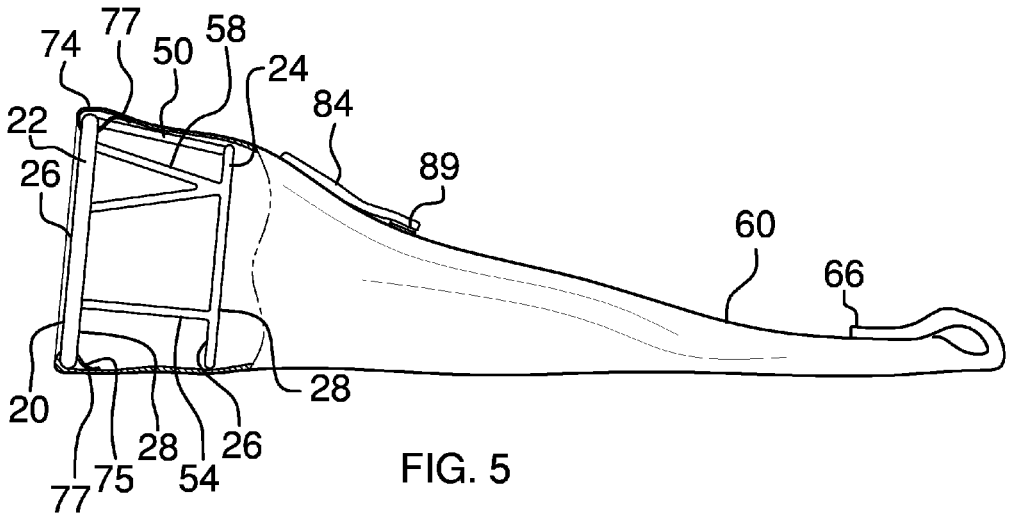
FIG. 5 is an in-use side elevation view.
Figure 6:
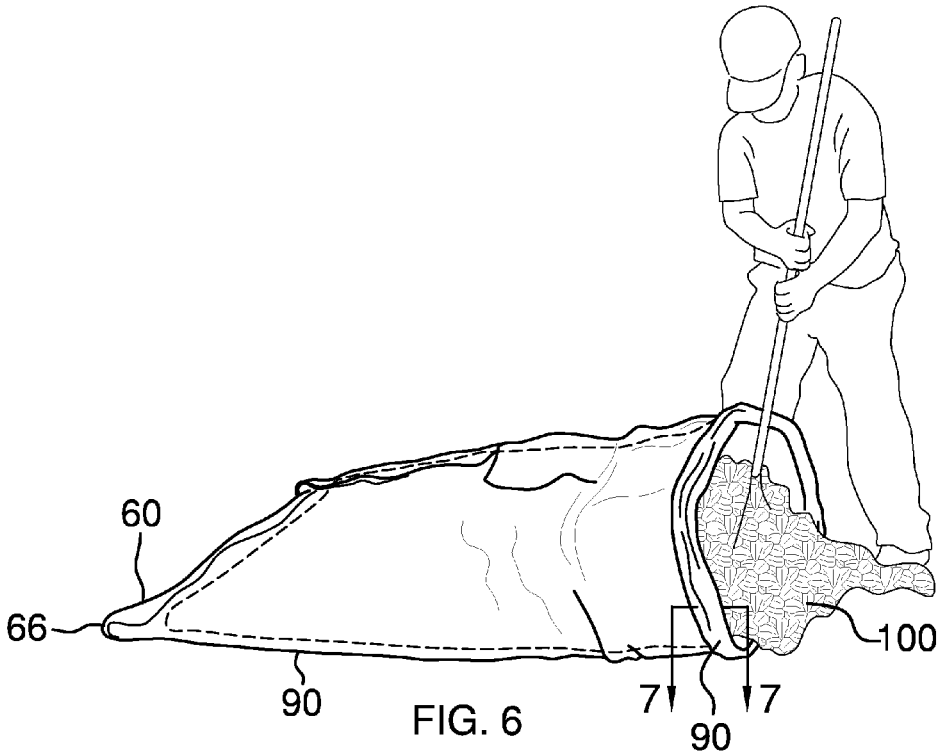
FIG. 6 is an in-use isometric view.
Figure 7:
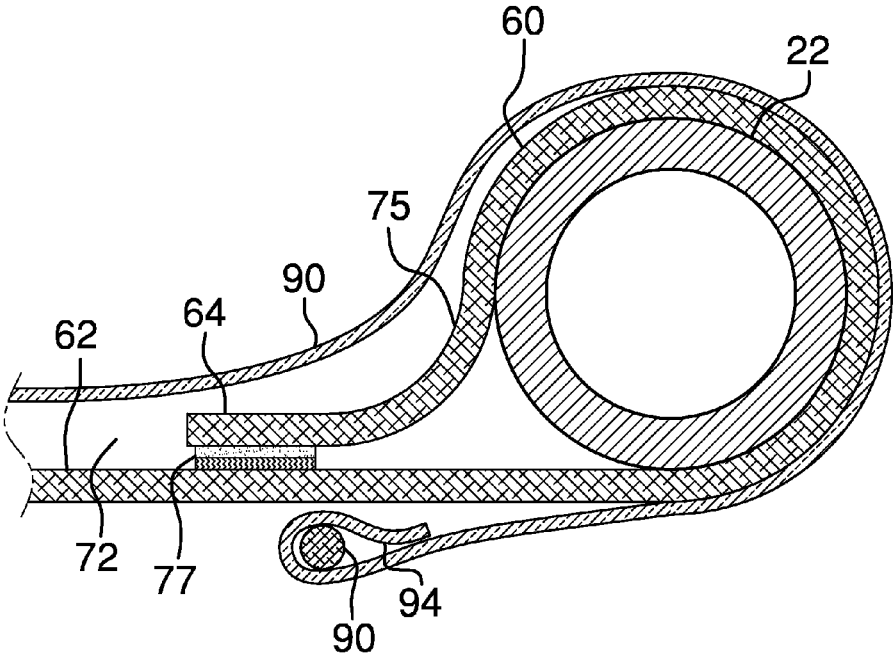
FIG. 7 is a cross-section view taken along line 7-7 of FIG. 6.

With reference now to the drawings, and in particular FIGS. 1 through 7 thereof, example of the instant yard refuse collection device employing the principles and concepts of the present yard refuse collection device and generally designated by the reference number 10 will be described.

Referring to FIGS. 1 through 7 a preferred embodiment of the present yard refuse collection device 10 is illustrated. The instant yard refuse collection device 10 includes a rigid support frame body 20. The rigid support frame body 20 includes a cylindrical front frame 22 and a cylindrical rear frame 24 disposed in a position parallel to the front frame 22. The rear frame 24 has a shorter perimeter than a perimeter of the front frame 22. Each of the front frame 22 and the rear frame 24 has a pentagonal shape. Each of the front frame 22 and the rear frame 24 has a front side 26, an inner side 28, a top side 30 having an apex 32 centrally disposed therein and opposite outer edges 34, a bottom side 36 having opposite external edges 38, a first end 40, and a second end 42. An internal cavity 46 is disposed between the front frame 22 and the rear frame 24. Each of the front frame 22 and the rear frame 24 may be hollow.

A cylindrical top brace 50 is centrally attached to the inner side 28 of each of the front and rear frames 22, 24 between the top side 30 apex 32 of each the front and rear frames 22, 24. A cylindrical bottom brace 52 is centrally attached to the inner side 28 of each of the front and rear frames 22, 24 between the bottom side 36 of each of the front and rear frames 22, 24. A cylindrical third brace 54 is attached to the inner side 28 of each of the front and rear frames 22, 24 between the first end 40 of each of the front and rear frames 22, 24. A cylindrical fourth brace 56 is centrally attached to the inner side 28 of each of the front and rear frames 22, 24 between the second end 42 of each of the front and rear frames 22, 24. The top brace 50, the bottom brace 52, the third brace 54, and the fourth brace 56 are disposed perpendicular to the top side 30 and the bottom side 36 of the front and rear frames 22, 24.

A plurality of V-shaped fifth braces 58 is attached to the inner side 28 of each of the front frame 22 and the rear frame 24. One of the fifth braces 58 is centrally disposed between the top brace 50 and the top side 30 outer edge 34 proximal to the third brace 54. Another one of the fifth braces 58 is centrally disposed between the top brace 50 and the top side 30 outer edge 34 proximal to the fourth brace 56. Still another one of the fifth braces 58 is centrally disposed between the bottom brace 52 and the bottom side 36 external edge 38 proximal to the first end 40. Yet another one of the fifth braces 58 is centrally disposed between the bottom brace 52 and the bottom side 36 external edge 38 proximal to the second end 42.

The present yard refuse collection device 10 also includes a reusable elongated collection bag 60. The collection bag 60 includes a rectangular lower side 62; a rectangular upper side 63; a front end 64, a rear end 66, a first side 68, and a second side 70; and an interior cavity 72 disposed between the lower side 62, the upper side 63, the front end 64, the rear end 66, the first side 68, and the second side 70. A elongated first loop 74 and a elongated second loop 75 are disposed within the interior cavity 72 proximal to the front end 64 on the upper side 63 and proximal to the front end 64 on the lower side 62, respectively. Each of the first loop 74 and the second loop 75 have at least one of a plurality of securement members 77 disposed on an exterior end 78 thereof and at least one of the securement members 77 disposed in a position on an internal wall 79 thereof. The securement member members 77 are removably releasable hook and loop fasteners. The collection bag 60 front end 64 continuously attaches to the front frame 22. The first and second loop 74, 75 securement members 77 continuously attach the collection bag 60 front end 64 to the front frame 22. The collection bag 60 extends rearwardly through internal cavity 46 between the front frame 22 and the rear frame 24. The collection bag 60 is smooth to permit refuse 100 to easily slide into the collection bag 80, durable to permit re-use, water-resistant to permit use in moist conditions and to pick up moist refuse 100 without damaging the collection bag 60, and lightweight to enhance portability of the present device 10.

At least one resealable elongated opening 80 is central disposed on the upper side 63. A resealable elongated top opening 82 is centrally disposed on the upper side 63 along a horizontal axis proximal to the front end 64 of the collection bag 60. A flap 84 releasably covers the entire top opening 82. A resealable elongated central opening 86 is centrally disposed on the upper side 63 between the first side 68 and the second side 70 in a position perpendicular to the top opening 82. A resealable elongated bottom opening 88 is disposed along the entire rear end 66. The central opening 86 is continuously disposed between the top opening 82 and the bottom opening 88. A removably attached pair of strips 89 of hook and loop fastening is disposed along each of the top opening 92 and the respective flap 84, the central opening 86, and the bottom opening 88. The strips 89 permit the upper side 63 of the collection bag 60 to be substantially completely opened.

A heavy-duty liner bag 90 having a drawstring 92 continuously disposed along a forward edge 94 thereof is also provided. The liner bag 90 forward edge 94 continuously removably attaches to the collection bag 60 front end 64 and the liner bag 90 is disposed within the collection bag 60 interior cavity 72. Thus, the liner bag 90, rather than the collection bag 60, removably contains refuse picked up from a yard therein. The openings 80, 82, 86, 88 allow the liner bag 90 to be easily removed from the collection bag 60 for disposal of the liner bag 90, which is sealed by pulling the drawstring 92 together prior to removal from the collection bag 60.

The front frame 22 has a perimeter having a length in a range of 88 inches to 108 inches. The rear frame 24 has a perimeter having a length in a range of 78 inches to 98 inches. These dimensions are optimal for portability of the device 10 when the collection bag 60 or, alternately, the liner bag 90 is full of refuse. The front frame 22 has a longer perimeter than the rear frame 24 to provide a wide mouth on the device 10 for raking and scooping refuse within the collection bag 60 or liner bag 90 while allowing the collection bag 60 or liner bag 90 to drape rearwardly down over the support frame body 20 to push refuse 100 collected therein toward the back of the collection bag 60 or liner bag 90 when the support frame body 20 is lifted. However, smaller and larger embodiments of the device 10 are provided to accommodate smaller and larger amounts of refuse, respectively. The support frame body 20 is formed of a durable, lightweight material including aluminum or polypropylene.

What is claimed is:

1. A yard refuse collection device comprising:

a rigid support frame body comprising:

a front frame;

a rear frame disposed in a position parallel to the front frame, the rear frame having a shorter perimeter than a perimeter of the front frame;

wherein each of the front frame and the rear frame have a pentagonal shape, a front side, an inner side, a top side having an apex centrally disposed therein and opposite outer edges, a bottom side having opposite external edges, a first end, and a second end;

an internal cavity disposed between the front frame and the rear frame;

a plurality of braces attached to the inner side of the front frame and the front side of the rear frame, the braces comprising:

a cylindrical top brace centrally attached between the top side apex of each the front and rear frames;

a cylindrical bottom brace centrally attached between the bottom side of each of the front and rear frames;

a cylindrical third brace centrally attached between the first end of each of the front and rear frames;

a cylindrical fourth brace centrally attached between the second end of each of the front and rear frames;

wherein the top brace, the bottom brace, the third brace, and the fourth brace are disposed perpendicular to the top side and the bottom side of the front and rear frames;

a plurality of V-shaped fifth braces;

wherein one of the fifth braces is centrally disposed between the top brace and the top side outer edge proximal to the third brace;

wherein one of the fifth braces is centrally disposed between the top brace and the top side outer edge proximal to the fourth brace;

wherein one of the fifth braces is centrally disposed between the bottom brace and the bottom side external edge proximal to the first end;

wherein one of the fifth braces is centrally disposed between the bottom brace and the bottom side external edge proximal to the second end; and a reusable elongated collection bag attached to the front frame and extending rearwardly through the internal cavity.

2. The yard refuse collection device of claim 1 wherein the collection bag comprises:

a rectangular lower side;

a rectangular upper side;

a front end, a rear end, a first side, and a second side;

an interior cavity disposed between the lower side, the upper side, the front end, the rear end, the first side and the second side;

at least one resealable elongated opening disposed on the upper side;

wherein the collection bag front end is continuously attached to the front frame;

wherein the collection bag interior cavity removably contains refuse therein.

3. The yard refuse collection device of claim 2 further comprising a removably attached pair of strips of hook and loop fastening is disposed along each opening.

4. The yard refuse collection device of claim 3 wherein the collection bag is smooth, durable, water-resistant, and lightweight.

5. The yard refuse collection device of claim 4 wherein the front frame has perimeter having a length in a range of 88 inches to 108 inches; and wherein the rear frame has a perimeter having a length in a range of 78 inches to 98 inches.

6. A yard refuse collection device comprising:

a rigid support frame body comprising:

a front frame;

a rear frame disposed in a position parallel to the front frame, the rear frame having a shorter perimeter than a perimeter of the front frame;

wherein each of the front frame and the rear frame have a pentagonal shape, a front side, an inner side, a top side having an apex centrally disposed therein and opposite outer edges, a bottom side having opposite external edges, a first end, and a second end;

an internal cavity disposed between the front frame and the rear frame;

a plurality of braces attached to the inner side of the front frame and the front side of the rear frame, the braces comprising:

a cylindrical top brace centrally attached between the top side apex of each the front and rear frames;

a cylindrical bottom brace centrally attached between the bottom side of each of the front and rear frames;

a cylindrical third brace centrally attached between the first end of each of the front and rear frames;

a cylindrical fourth brace centrally attached between the second end of each of the front and rear frames;

wherein the top brace, the bottom brace, the third brace, and the fourth brace are disposed perpendicular to the top side and the bottom side of the front and rear frames;

a plurality of V-shaped fifth braces;

wherein one of the fifth braces is centrally disposed between the top brace and the top side outer edge proximal to the third brace;

wherein one of the fifth braces is centrally disposed between the top brace and the top side outer edge proximal to the fourth brace;

wherein one of the fifth braces is centrally disposed between the bottom brace and the bottom side external edge proximal to the first end;

wherein one of the fifth braces is centrally disposed between the bottom brace and the bottom side external edge proximal to the second end; and a reusable elongated collection bag comprising:

a rectangular lower side;

a rectangular upper side;

a front end, a rear end, a first side, and a second side;

an interior cavity disposed between the lower side, the upper side, the front end, the rear end, the first side and the second side;

a resealable elongated top opening centrally disposed on the upper side along a horizontal axis proximal to the front end;

a flap releasably covering the entire top opening;

a resealable elongated central opening centrally disposed on the upper side in a position perpendicular to the top opening;

a resealable elongated bottom opening disposed along the entire rear end;

wherein the central opening is continuously disposed between the top opening and the bottom opening;

an elongated first loop and a elongated second loop disposed within the interior cavity proximal to the front end on the upper side and proximal to the front end on the lower side, respectively, each of the first loop and the second loop having at least one of a plurality of securement members disposed on an exterior end thereof and at least one of the securement members disposed in a position on an internal wall thereof;

wherein the first loop and the second loop securement members continuously attach the collection bag front end to the front frame;

wherein the collection bag extends rearwardly through internal cavity between the front frame and the rear frame;

wherein the collection bag interior cavity removably contains refuse therein.

7. The yard refuse collection device of claim 6 further comprising a removably attached pair of strips of hook and loop fastening disposed along each of the top opening and the respective flap, the central opening, and the bottom opening; and wherein the securement members are removably releasable hook and loop fasteners.

8. The yard refuse collection device of claim 7 wherein the collection bag is smooth, durable, water-resistant, and lightweight.

9. The yard refuse collection device of claim 8 wherein the front frame has a perimeter having a length in a range of 88 inches to 108 inches; and wherein the rear frame has a perimeter having a length in a range of 78 inches to 98 inches.

10. A yard refuse collection device comprising:

a rigid support frame body comprising:

a front frame;

a rear frame disposed in a position parallel to the front frame, the rear frame having a shorter perimeter than a perimeter of the front frame;

wherein each of the front frame and the rear frame have a pentagonal shape, a front side, an inner side, a top side having an apex centrally disposed therein and opposite outer edges, a bottom side having opposite external edges, a first end, and a second end;

an internal cavity disposed between the front frame and the rear frame;

a plurality of braces attached to the inner side of the front frame and the front side of the rear frame, the braces comprising:

a cylindrical top brace centrally attached between the top side apex of each the front and rear frames;

a cylindrical bottom brace centrally attached between the bottom side of each of the front and rear frames;

a cylindrical third brace centrally attached between the first end of each of the front and rear frames;

a cylindrical fourth brace centrally attached between the second end of each of the front and rear frames;

wherein the top brace, the bottom brace, the third brace, and the fourth brace are disposed perpendicular to the top side and the bottom side of the front and rear frames;

a plurality of V-shaped fifth braces;

wherein one of the fifth braces is centrally disposed between the top brace and the top side outer edge proximal to the third brace;

wherein one of the fifth braces is centrally disposed between the top brace and the top side outer edge proximal to the fourth brace;

wherein one of the fifth braces is centrally disposed between the bottom brace and the bottom side external edge proximal to the first end;

wherein one of the fifth braces is centrally disposed between the bottom brace and the bottom side external edge proximal to the second end; and a reusable elongated collection bag comprising:

a rectangular lower side;

a rectangular upper side;

a front end, a rear end, a first side, and a second side;

an interior cavity disposed between the lower side, the upper side, the front end, the rear end, the first side and the second side;

a resealable elongated top opening centrally disposed on the upper side along a horizontal axis proximal to the front end;

a flap releasably covering the entire top opening;

a resealable elongated central opening centrally disposed on the upper side in a position perpendicular to the top opening;

a resealable elongated bottom opening disposed along the entire rear end;

wherein the central opening is continuously disposed between the top opening and the bottom opening;

an elongated first loop and a elongated second loop disposed within the interior cavity proximal to the front end on the upper side and proximal to the front end on the lower side, respectively, each of the first loop and the second loop having at least one of a plurality of securement members disposed on an exterior end thereof and at least one of the securement members disposed in a position on an internal wall thereof;

wherein the first loop and the second loop securement members continuously attach the collection bag front end to the front frame;

wherein the collection bag extends rearwardly through internal cavity between the front frame and the rear frame;

a heavy-duty liner bag having a drawstring continuously disposed along a forward edge thereof;

wherein the liner bag forward edge continuously removably attaches to the collection bag front end;

wherein the liner bag is disposed within the collection bag interior cavity;

wherein the liner bag removably contains refuse therein.

11. The yard refuse collection device of claim 10 further comprising a removably attached pair of strips of hook and loop fastening disposed along each of the top opening and the respective flap, the central opening, and the bottom opening; and wherein the securement members are removably releasable hook and loop fasteners.

12. The yard refuse collection device of claim 11 wherein the collection bag is smooth, durable, water-resistant, and lightweight.

13. The yard refuse collection device of claim 12 wherein the front frame has a perimeter having a length in a range of 88 inches to 108 inches; and wherein the rear frame has a perimeter having a length in a range of 78 inches to 98 inches.

* * * * *